US008312803B2

(12) United States Patent
Oz

(10) Patent No.: US 8,312,803 B2
(45) Date of Patent: Nov. 20, 2012

(54) SEMI AUTOMATIC PISTOL SLIDE PULL

(75) Inventor: Moshe Oz, Ramat-Gan (IL)

(73) Assignee: Tactical Arms Ltd., Natania (IL)

( * ) Notice: Subject to any disclaimer, the term of this patent is extended or adjusted under 35 U.S.C. 154(b) by 124 days.

(21) Appl. No.: 12/844,106

(22) Filed: Jul. 27, 2010

(65) Prior Publication Data

US 2011/0088539 A1 Apr. 21, 2011

(30) Foreign Application Priority Data

Oct. 19, 2009 (IL) ..... 201628

(51) Int. Cl.
*F41A 19/00* (2006.01)

(52) U.S. Cl. ..... 89/1.4; 89/1.42; 42/71.02

(58) Field of Classification Search ..... 42/90, 106, 42/108; 89/1.4, 1.42
See application file for complete search history.

(56) References Cited

U.S. PATENT DOCUMENTS

| | | | | |
|---|---|---|---|---|
| 1,680,186 | A * | 8/1928 | Von Frommer | 42/106 |
| 3,685,194 | A | 8/1972 | Coon | |
| 4,176,584 | A * | 12/1979 | Thomas et al. | 89/138 |
| 4,793,085 | A * | 12/1988 | Surawski et al. | 42/84 |
| 5,448,940 | A * | 9/1995 | Schuetz et al. | 89/185 |
| 6,318,014 | B1 | 11/2001 | Porter | |
| 6,493,978 | B1 * | 12/2002 | Perkins | 42/70.11 |
| 8,015,741 | B2 * | 9/2011 | Hooks | 42/70.01 |
| 2010/0024274 | A1 * | 2/2010 | Lippard | 42/70.05 |
| 2011/0010978 | A1 * | 1/2011 | Hooks | 42/69.01 |
| 2011/0154710 | A1 * | 6/2011 | Hatfield | 42/90 |

FOREIGN PATENT DOCUMENTS

FR 1228795 9/1960

OTHER PUBLICATIONS

UK Office Action issued in the corresponding UK application No. GB1017627.9, dated Mar. 3, 2011.

* cited by examiner

*Primary Examiner* — Michael Carone
*Assistant Examiner* — Joshua Freeman
(74) *Attorney, Agent, or Firm* — The Law Office of Michael E. Kondoudis

(57) ABSTRACT

Disclosed is a slide pull apparatus for aiding in pulling a slide on a semi-automatic pistol. The slide pull apparatus includes a shell configured to partially enclose a rear portion of a slide on a semi-automatic pistol, the shell including: a plate having an aperture of a size configured to surround at least a portion of a rear aim sight on the semi-automatic pistol. The slide pull apparatus additionally includes at least one finger tab projecting from the slide pull, the finger projection having a size configured to accommodate at least one finger of a human hand, wherein pulling on the at least one finger tab in a rearward direction causes the slide to move in a rearward direction, thereby facilitating loading of the semi-automatic pistol.

7 Claims, 2 Drawing Sheets

(EXISTING ART)

SEMI AUTOMATIC PISTOL SLIDE PULL

CROSS-REFERENCE TO RELATED APPLICATION

This application claims priority to Israeli Patent Application Ser. No. 201628, filed Oct. 19, 2009, which is incorporated by reference in its entirety, as if fully set forth herein.

BACKGROUND

1. Technical Field

The present invention, in some embodiments thereof, relates to a slide pull that fits on a semi-automatic pistol, and, more particularly, but not exclusively, to a slide pull that fits on a Glock semi-automatic pistol.

2. Discussion of the Related Art

Glock is the name of a family of popular semi-automatic pistols designed and produced by the Austrian company Glock GmbH or Deutsch-Wagram. A typical Glock semi-automatic pistol has a 9 mm short recoil-operated locked breech.

The Glock semi-automatic pistol, while a popular hand weapon, may pose some difficulties for a user. To cock the pistol for the first shot, the spring-loaded slide must be pulled toward the user. A professional, for example a policeman often pulls the slide with the palm of the opposite hand to the hand on the pistol grip in a single motion as the Glock is pulled from a side holster.

An occasional user, for example teenagers and women at a target range, may hold the pistol while tracking a target and use the thumb and index finger of the opposite hand to pull back the Glock slide. It is difficult to pull the spring-loaded slide with the thumb and index fingers. Additionally, this style of pull the slide often causes the hand grasping the pistol to move, causing time wastage as the user retrains the pistol on the target; or inaccuracy in hitting the target.

BRIEF SUMMARY

According to an aspect of some embodiments of the invention, there is provided a slide pull apparatus for aiding in pulling a slide on a semi-automatic pistol, the slide pull apparatus comprising a shell configured to partially enclose a rear portion of a slide on a semi-automatic pistol. In embodiments, the shell includes a plate having an aperture of a size configured to surround at least a portion of a rear aim sight on the semi-automatic pistol. Additionally the shell includes two sidewalls extending downward from the plate, each of the two sidewalls having an inner surface configured to each rest against a side portion of a slide of the semi-automatic pistol, wherein pulling on the slide pull in a rearward direction causes the slide to move in a rearward direction, thereby facilitating loading of the semi-automatic pistol.

According to some embodiments of the invention, the apparatus includes at least one finger tab projecting from the shell, the finger projection having a size configured to accommodate at least one finger of a human hand.

According to some embodiments of the invention, the at least one finger pull projects laterally outward from one of the two sidewalls of the slide pull apparatus.

According to some embodiments of the invention, the at least one finger pull comprises two finger pulls, each projecting laterally outward from a respective outer surface of one of the two sidewalls.

According to some embodiments of the invention, the inner surface of at least one of the two sidewalls includes at least one rib configured to offset at least a portion of the at least one of the two sidewalls from the slide of the semi-automatic pistol.

According to some embodiments of the invention, the inner surface of each of the two sidewalls includes at least one rib configured to offset at least a portion of the respective sidewall from the slide of the semi-automatic pistol.

According to another aspect of some embodiments of the invention, there is provided a slide pull apparatus for aiding in pulling a slide on a semi-automatic pistol. The slide pull apparatus includes a shell configured to partially enclose a rear portion of a slide on a semi-automatic pistol, the shell including: a plate having an aperture of a size configured to surround at least a portion of a rear aim sight on the semi-automatic pistol. The slide pull apparatus additionally includes at least one finger tab projecting from the slide pull, the finger projection having a size configured to accommodate at least one finger of a human hand, wherein pulling on the slide pull in a rearward direction causes the slide to move in a rearward direction, thereby facilitating loading of the semi-automatic pistol.

According to some embodiments of the invention, the apparatus includes two sidewalls extending downward from the plate, each of the two sidewalls having an inner surface configured to each rest against a side portion of a slide of the semi-automatic pistol.

According to some embodiments of the invention, the inner surface of at least one of the two sidewalls includes at least one rib configured to offset at least a portion of the at least one of the two sidewalls from the slide of the semi-automatic pistol.

According to some embodiments of the invention, the inner surface of each of the two sidewalls includes at least one rib configured to offset at least a portion of the respective sidewall from the slide of the semi-automatic pistol.

According to some embodiments of the invention, the at least one finger tab projects laterally outward from at least one outer surface of the two side walls.

According to some embodiments of the invention, the at least one finger pull comprises two finger pulls, each projecting laterally outward from a respective outer surface of one of the two sidewalls.

According to still another aspect of some embodiments of the invention, there is provided a slide pull apparatus for aiding in pulling a slide on a semi-automatic pistol, the slide pull apparatus comprising a shell configured to partially enclose a rear portion of a slide on a semi-automatic pistol, the shell including: a plate having an aperture of a size configured to surround at least a portion of a rear aim sight on the semi-automatic pistol, two sidewalls extending downward from the plate, each of the two sidewalls having an inner surface having a projection configured to each rest against a side portion of a slide of the semi-automatic pistol, and one finger tab projecting laterally outward from an outer surface of each of the sidewalls, the finger projection having a size configured to accommodate at least one finger of a human hand, wherein pulling on at least one finger tab in a rearward direction causes the slide to move in a rearward direction, thereby facilitating loading of the semi-automatic pistol.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DETAILED DESCRIPTION

Figure 1:
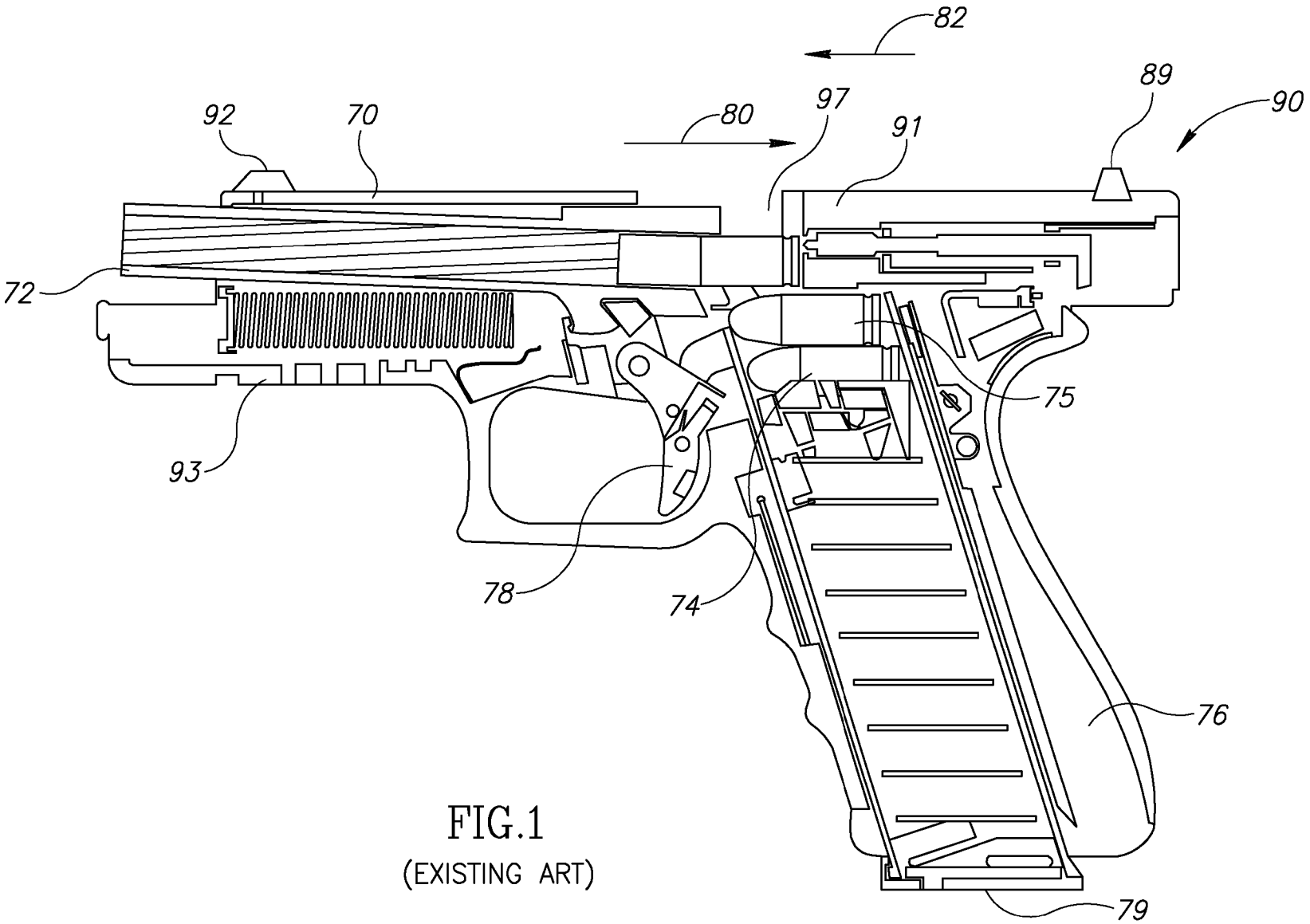
FIG. 1 shows an existing semi-automatic pistol.

The present invention, in some embodiments thereof, relates to assemblies that convert a semi-automatic hand pistol into a rifle, and, more particularly, but not exclusively, to an assembly that converts a Glock semi-automatic pistol into a rifle.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring to FIG. 1, before firing a bullet 74 from a Glock semi-automatic pistol 90, herein Glock 90, a slide 70 must be pulled back in a first direction 80 to allow bullet 74 to move into a barrel 72 from a magazine 76, which is located in a pistol grip 79. Slide 70 and barrel 72 then move forward in a direction 82 and Glock 90 is ready to be fired.

After a trigger 78 is pulled, barrel 72 moves rearward, initially locked together with slide 70 until bullet 74 leaves barrel 72 through an ejection passage. Barrel 72 then unlocks from slide 70.

During continued backward movement of slide 70, barrel 72 tilts slightly in preparation for receiving another bullet 74.

Slide 70 continues uninterrupted movement backward in direction 80 under recoil power, extracting and ejecting the spent cartridge of bullet 74, allowing a second bullet 75 to move via spring action to align with barrel 72.

The next bullet 74 automatically enter barrel 72 during recoil of Glock 90 without pullback of slide 70 until the shooting session has finished or magazine 76 has been emptied of bullets 74.

Figure 2:
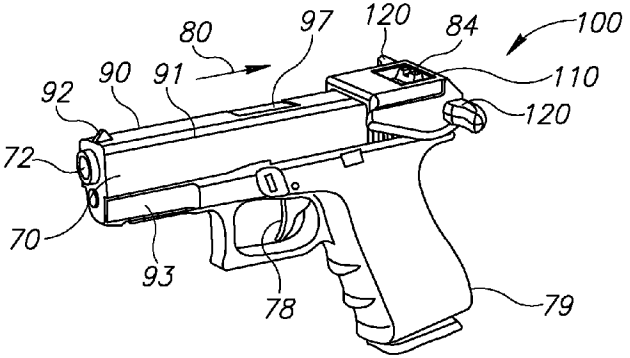
FIG. 2 shows a slide pull mounted on a schematic drawing of the pistol shown in FIG. 1, according to some embodiments of the invention.

FIG. 2 shows a slide case 100 mounted on a schematic drawing of pistol 90. A rear aim sight 84 extends into a rear aim sight aperture 110, thereby locking slide case 100 in position along slide 70.

Figure 3:
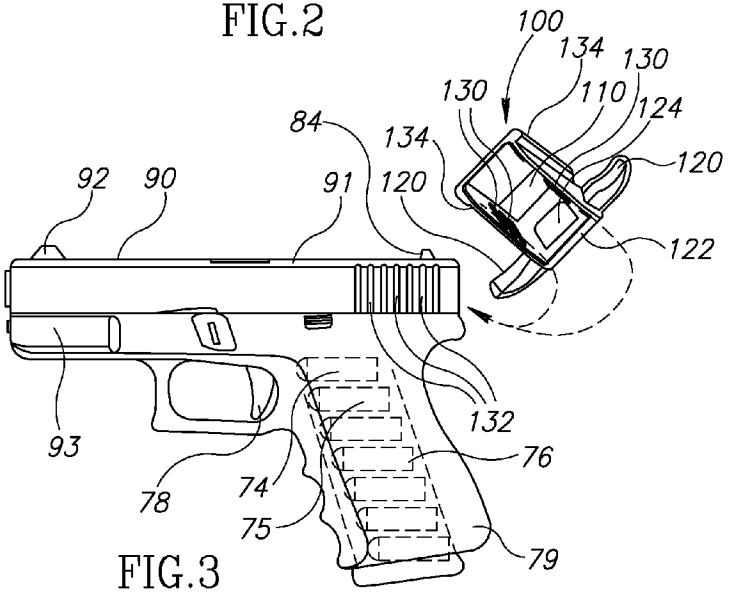
FIGS. 3-4 show pistol of FIG. 1 in schematic and plan views respectively, in conjunction with schematic drawings of slide pull of FIG. 2 in various views, according to some embodiments of the invention.
Figure 4:
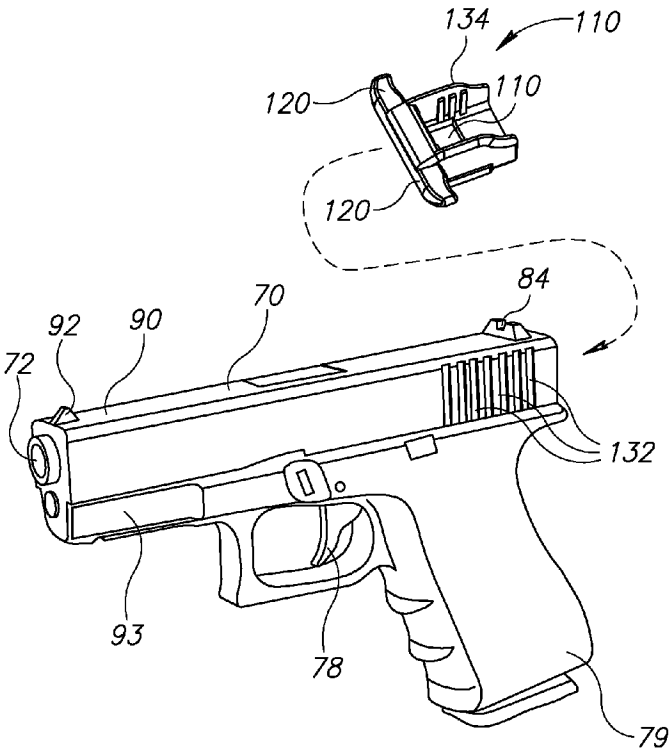

FIGS. 3-4, to better appreciate some of the details of slide case 100 shown in schematic views, show Glock pistol 90 in schematic and plan views respectively.

For example, a ledge 122 fits above the lower edge of slide 70 when slide case 100 is placed in position on Glock 90 according to dashed lines 126 (FIG. 3). Additionally slide case 100 includes an indentation 124 to accommodate the profile of the rear portion of slide 70.

Ribs 130 on side walls 134 create a distance between pistol corrugations 132 (FIG. 4) and allow ventilation of Glock 90 when slide casing is positioned on Glock 90, as indicated by an arrow 140.

While three ribs 130 are shown, slide case 100 may have as few as one rib on each side wall 134, or as many as about 10 on each side wall.

Side case lateral flanges 120 act as finger grips, alternatively referred to as "finger tabs", with which a user pulls slide casing 100, together with slide 91 in rearward direction 80, thereby allowing first bullet 74 to enter barrel 72.

Thereafter, the next bullet 75 automatically enter barrel 72 during recoil of Glock 90 as noted above.

It is expected that during the life of a patent maturing from this application many relevant slide pulls will be developed and the scope of the term slide pull is intended to include all such new technologies a priori.

The terms "comprises", "comprising", "includes", "including", "having" and their conjugates mean "including but not limited to".

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications, and variations will be apparent to those skilled in the art. Accordingly, it is intended to embrace all such alternatives, modifications, and variations that fall within the spirit and broad scope of the appended claims.

All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A slide pull apparatus for aiding in pulling a slide on a semi-automatic pistol, the slide pull apparatus comprising a shell configured to partially enclose a rear portion of a slide on a semi-automatic pistol, said shell including:

i) a plate having an aperture of a size configured to surround at least a portion of a rear aim sight on the semi-automatic pistol; and ii) at least one finger tab projecting from said slide pull, said finger tab having a size configured to accommodate at least one finger of a human hand, wherein pulling on said at least one finger tab in a rearward direction causes said slide to move in a rearward direction, thereby facilitating loading of the semi-automatic pistol.

2. The apparatus according to claim 1, including two sidewalls extending downward from said plate, each of said two sidewalls having an inner surface configured to each rest against a side portion of a slide of the semi-automatic pistol.

3. The apparatus according to claim 2, wherein said inner surface of at least one of said two sidewalls includes at least one rib configured to offset at least a portion of said at least one of said two sidewalls from said slide of said semi-automatic pistol.

4. The apparatus according to claim 2, wherein said inner surface of each of said two sidewalls includes at least one rib configured to offset at least a portion of said respective sidewall from said slide of said semi-automatic pistol.

5. The apparatus according to claim 2, wherein said at least one finger tab projects laterally outward from at least one outer surface of said two side walls.

6. The apparatus according to claim 2, wherein said at least one finger pull comprises two finger stabs, each projecting laterally outward from a respective outer surface of one of said two sidewalls.

7. A slide pull apparatus for aiding in pulling a slide on a semi-automatic pistol, the slide pull apparatus comprising a shell configured to partially enclose a rear portion of a slide on a semi-automatic pistol, said shell including:

i) a plate having an aperture of a size configured to surround at least a portion of a rear aim sight on the semi-automatic pistol;

ii) two sidewalls extending downward from said plate, each of said two sidewalls having an inner surface having a projection configured to each rest against a side portion of a slide of the semi-automatic pistol; and iii) one finger tab projecting laterally outward from an outer surface of each of said sidewalls, said finger tab having a size configured to accommodate at least one finger of a human hand, wherein pulling on at least one finger tab in a rearward direction causes said slide to move in a rearward direction, thereby facilitating loading of the semi-automatic pistol.

* * * * *